United States Patent [19]

Finlay

[11] 4,303,506

[45] Dec. 1, 1981

[54] SCREENING APPARATUS

[75] Inventor: John A. Finlay, Ballygawley, Northern Ireland

[73] Assignee: John Finlay (Engineering) Limited, Ballygawley, Northern Ireland

[21] Appl. No.: 146,306

[22] Filed: May 5, 1980

[30] Foreign Application Priority Data

May 16, 1979 [GB] United Kingdom ..... 17098/79

[51] Int. Cl.[3] ..... B07B 1/46

[52] U.S. Cl. ..... 209/247; 209/421; 198/313; 56/14.5

[58] Field of Search ..... 209/241, 245, 247, 260, 209/420, 421, 635; 198/313, 632; 414/332, 619; 56/14.5

[56] References Cited

U.S. PATENT DOCUMENTS

| | | | |
|---|---|---|---|
| 2,632,556 | 3/1953 | Alpers | 198/313 X |
| 2,834,487 | 5/1958 | Gaddis | 198/313 X |
| 2,922,510 | 1/1960 | Zetterlund | 209/241 X |
| 3,051,295 | 8/1962 | Moy | 198/313 X |
| 3,439,806 | 4/1969 | Kass | 209/420 X |
| 3,493,136 | 2/1970 | Spellman | 198/313 X |
| 3,599,784 | 8/1971 | Rossi | 198/313 |
| 3,642,155 | 2/1972 | Carlson | 198/313 X |
| 4,190,526 | 2/1980 | Bachand | 209/421 X |

*Primary Examiner*—Robert Halper

*Attorney, Agent, or Firm*—McCormick, Paulding & Huber

[57] ABSTRACT

A screening apparatus includes a conveyor (14) pivotally mounted on a wheeled chassis (2) for movement between an extended operational position and a folded transporting position. The conveyor (14) includes an endless belt (16) and a boom frame (20) supporting the belt (16). The boom frame (20) consists of a rear section (24) pivotally mounted on the chassis (2), and a forward section (26) pivotally mounted to the rear section (24). A screen device (54) is pivotally coupled to the conveyor forward section (26), and a hopper (12) is mounted at the rear of the chassis (2).

To erect the apparatus, the conveyor section (26) is swung down to straighten the conveyor (14), and hydraulic rams (30) are operated to raise the conveyor (14) sufficiently to move the screen device (54) by means of a hydraulic ram (66). The rams (30) then raise the conveyor (14) to a desired operational position, and locating pins are inserted through aligned box members in box member assemblies (34) to retain the conveyor (14) in its operational position. The ram (66) is then operated to swing the screen device (54) into its operational position. After use, the screening apparatus is returned to its transporting position by carrying out the aforementioned operations in reverse order.

4 Claims, 3 Drawing Figures

SCREENING APPARATUS

TECHNICAL FIELD

The present invention relates to an apparatus for separating particulate material into particles of different sizes, and such apparatus will hereinafter be referred to as a screening apparatus. A screening apparatus possesses a considerable number of different applications, but it is particularly suitable for separating material such as sand, gravel, stone, coal, ash, soil and particulate minerals.

BACKGROUND ART

In a previously proposed screening apparatus, the material to be screened is fed onto the input stage of an elongate conveyor which conveys the material to a screen device for separating the material into particles of different sizes. The separated materials are then either deposited at different locations on the ground, or passed onto associated separate conveyors which convey the particles of different sizes to locations which are remote from one another.

In order to prevent the separated material from becoming inadvertently mixed with the initial unseparated material it is desirable for the separated material to be deposited a reasonable distance from the input stage of the conveyor. Consequently, it is necessary for the conveyor to be of a considerable length, and for this reason difficulties can arise in transporting the screening apparatus on a public highway or for any appreciable distance on site.

STATEMENT OF INVENTION AND ADVANTAGES

The invention provides a screening apparatus as herein defined comprising an elongate conveyor adjustably mounted on a wheeled chassis, and a screen device adjustably connected to the outlet stage of the conveyor, in which the conveyor comprises a plurality of mutually adjustable sections whereby the conveyor sections and screen device are movable between an operational position and a transporting position. By "operational position" is meant that the conveyor sections and screen device are arranged ready to effect separation of material into particles of different sizes, and by "transporting position" is meant that the conveyor sections and screen device are arranged on the wheeled chassis in such a way that the screening apparatus can travel, along a public highway for example, without any undue inconvenience.

In a preferred arrangement, the conveyor rear section is pivotably mounted on the wheeled chassis, the screen device is pivotally connected to the output stage of the conveyor forward section, and the conveyor sections are pivotally connected to one another. With this preferred arrangement, when the conveyor sections and screen device are in the transporting position, the conveyor sections and the screen device are pivoted so as to be folded back on one another, and parallel to one another and to the wheeled chassis.

FIGURES IN THE DRAWINGS

One embodiment of a screening apparatus of the invention will now be described by way of example with reference to the accompanying illustrative drawings in which:

FIGS. 1A and 1B in combination are a side elevation of a screening apparatus in its operational position, and FIG. 2 is a side elevation of a screening apparatus of FIG. 1 in its transporting position.

DETAILED DESCRIPTION OF DRAWINGS

Figure 1A:
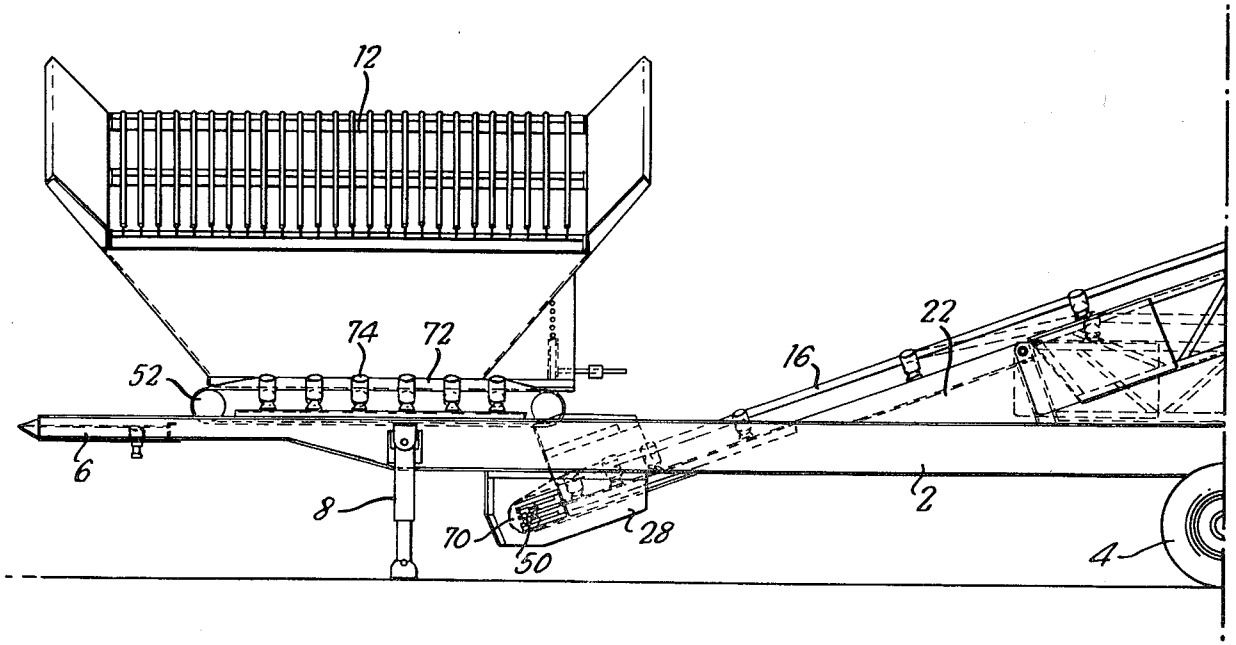

Referring to the drawings, the apparatus includes a chassis 2 mounted on four ground wheels 4, and having a coupling 6 generally known as a fifth wheel coupling at what will be referred to as its rear end. When the apparatus is not attached to a towing vehicle, the apparatus rests on the four ground wheels 4 and two transversely spaced legs 8 located near the chassis rear end. As will be seen from the drawings, the ground wheels 4 and the legs 8 are dimensioned and arranged so that the chassis is substantially parallel to the ground when resting on the ground wheels and legs.

Two transversely spaced forward legs 10 are mounted on the chassis adjacent to the ground wheels 4. These forward legs 10 are manually operable as will hereinafter be described so that they can be extended to enable the chassis to stand on the four legs 8 and 10 with the ground wheels 4 slightly off the ground, or they can be retracted away from the ground to enable the chassis to stand on the rear legs 8 and the ground wheels 4.

An input hopper 12 for receiving the particulate material to be separated is mounted on the rear part of the chassis 2, and this hopper 12 is dimensioned and shaped so that it can readily be fed from a conventional earth moving lorry. A conveyor 14 is adjustably mounted on the chassis 2 so that when in its operational position it extends forwardly and upwardly from the hopper outlet. The conveyor 14 includes an endless belt 16 which is guided and powered by spaced pulley wheels 18 which are mounted on an elongate boom frame 20 and on an inclined conveyor ramp 22. This boom frame 20 consists of a rear section 24 pivotally mounted at its rear to a forward portion of the ramp 22 and a forward section 26 pivotally mounted at its rear to the forward part of the rear section 24. A rear portion of the ramp is let into a well 28 in the chassis 2. Two transversely spaced hydraulic rams 30 are mounted on a forward part of the wheeled chassis 2 and connected at their upper ends to a transverse coupling rod 32 near the front of the rear conveyor section 24. Two transversely spaced telescopically adjustable box member assemblies 34 are mounted at their lower ends on the forward part of the wheeled chassis 2 and connected at their upper ends to a transverse box girder 36 which is mounted on the rear conveyor section near to the coupling rod 32. Opposite ends of the box girder 36 are connected to associated ends of the coupling rod 32 by two transversely spaced coupling brackets 38. Each box member of the two box member assemblies 34 has a series of longitudinally spaced holes therein, and the box member assemblies may be retained in any position by inserting pins through aligned box members in each assembly.

Figure 1B:
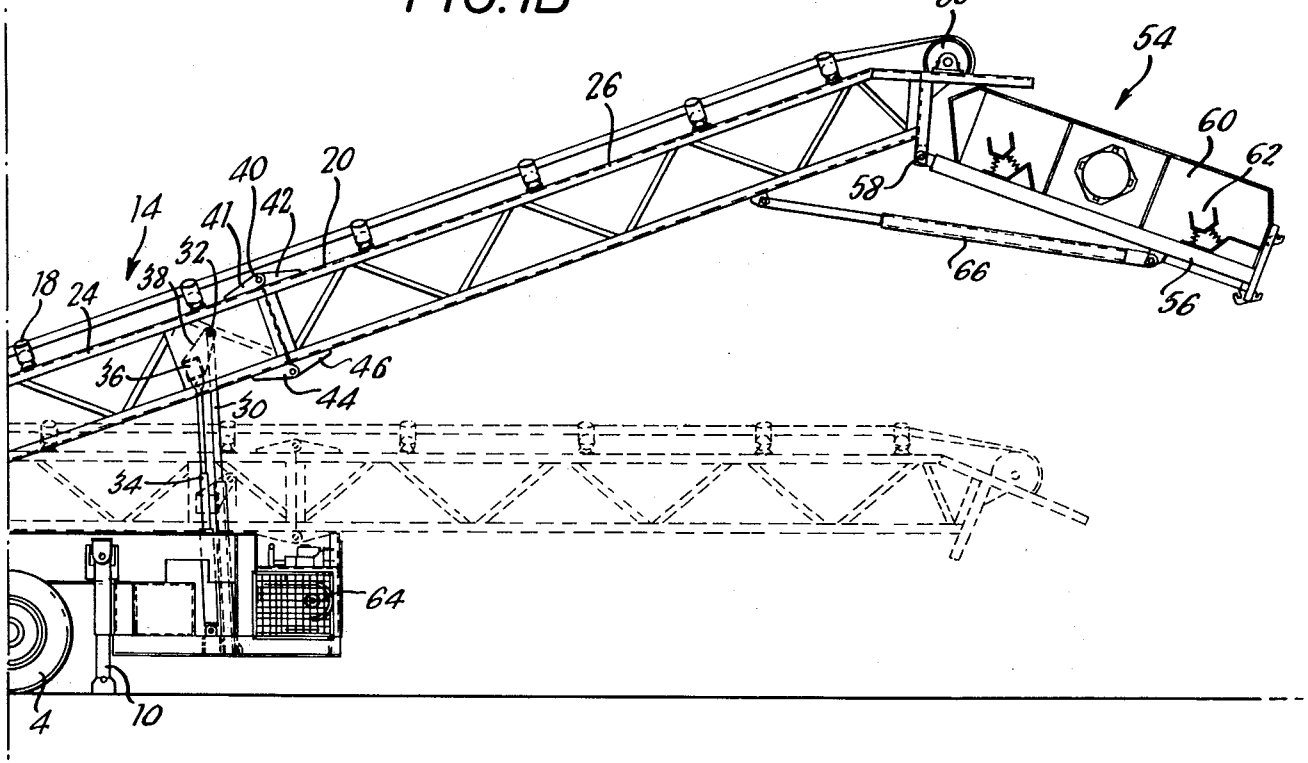

The two conveyor sections 24 and 26 are pivotally connected by a pivot rod 40 which extends through two sets 41 and 42 of transversely spaced brackets mounted on the upper side of the two conveyor sections. Two similar sets of brackets 44 and 46 are mounted on the lower side of the conveyor sections, and holes are located through these brackets 44 and 46 so as to be aligned when the conveyor sections are in their operational position as illustrated in FIG. 1. The two conveyor sections 24 and 26 are retained in their operational position by inserting a coupling rod through the aligned holes in the brackets 44 and 46. The desired tension is maintained in the conveyor belt 16 by means of a belt-tightening mechanism 50 located in the well 28.

In the illustrated embodiment, the material to be separated is fed from the hopper 12 onto the input stage of the conveyor 14 by means of a belt feeder assembly 52, but it is to be understood that the material can be fed by any other suitable means, such as for example, a plate feeder assembly or a vibratory feeder assembly.

A screen device 54 includes a support base 56 pivotally coupled at its rear to a transverse rod 58 mounted at the forward end of the forward conveyor section 26. Two parallel screens are mounted one above the other in a screen frame 60, and the apertures in the upper screen are of larger diameter than the apertures in the lower screen. The screen frame 60 is spring-mounted on the support base 56 by means of eight spring mountings 62, four of which are illustrated in the drawings. The screen device 54 is inclined forwardly and downwardly and arranged so that the material leaving the conveyor drops onto the upper rearward end of the screen frame 60. A vibratory device comprises an inner eccentric shaft rotatably mounted inside an outer cylinder which extends across and is mounted to opposite sides of the screen frame. The inner shaft is driven by a diesel engine 64 located at the forward end of the chassis 2, and the consequent high speed rotation of this eccentric shaft imparts a vibratory movement to the screen frame 60 and its associated screens.

Figure 2:
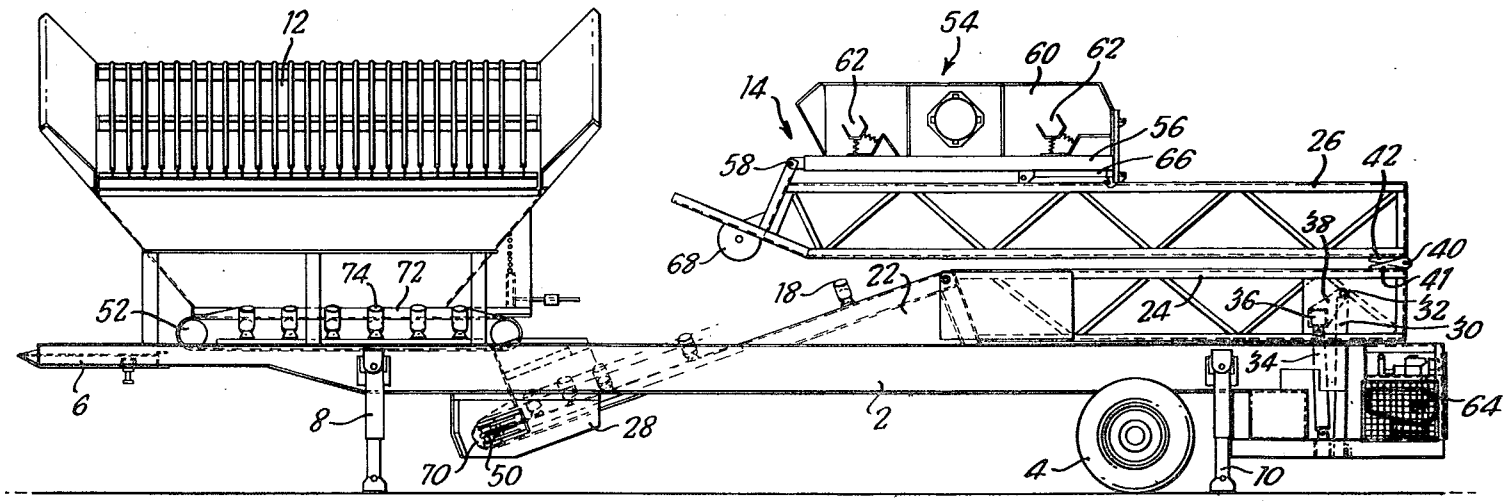

The support base 56 is coupled to the conveyor forward section 26 by a hydraulic ram 66 which is operable between its extended position locating the screen device 54 in its operational position illustrated in FIG. 1, and its retracted position locating the screen device 54 in its transporting position illustrated in FIG. 2. The ram 66 can position the screen device 54 for maximum screening efficiency.

The diesel engine 64 drives a hydraulic pump which is contained in a hydraulic power pack and fed from a hydraulic reservoir tank. Hydraulic energy is directed via a three-way three position control valve which is mounted on the hydraulic tank. By operating appropriate control levers on the control valve the hydraulic energy is used to operate elected one or ones of the conveyor belt 16, the inner shaft of the screen frame vibratory device, the hydraulic rams 30 of the rear conveyor section 24, and the hydraulic ram 66 for adjusting the position of the screen device 54.

The conveyor belt 16 is driven from its top drum pulley 68 which is itself driven by the aforementioned hydraulic power. The conveyor belt bottom drum pulley 70 is an idler pulley. The pulley wheels 18 at the top side of the conveyor 14 are troughing roller sets; each roller set comprising a central roller parallel to the top side of the conveyor 14, and two side rollers inclined upwardly from the central roller to shape the conveyor belt 16 in the form of a shallow trough.

The belt feeder assembly 52 includes an endless feeder belt 72 which is driven from the conveyor bottom drum pulley 70 by means of a chain and sprockets system. At the upper side of the belt feeder assembly 52, the feeder belt 72 passes over and is shaped by troughing roller sets 74.

When the screening apparatus has arrived at a desired site location, the two legs 8 of the chassis 2 are cranked down to contact the ground thereby taking the weight off the fifth wheel coupling 6. The connecting air lines and power line are uncoupled from the towing vehicle which is then driven away. The forward legs 10 are then cranked so that they are extended sufficiently to take load off the four ground wheels 4. The rear legs 8 are then adjusted in length so as to level the frame of the chassis 2.

The forward conveyor section 26 is then swung down so as to straighten the conveyor 14, and a coupling rod or pin is inserted through the aligned holes in the brackets 44 and 46 to retain the conveyor sections 24 and 26 in their straightened operational position. The hydraulic rams 30 are then operated so as to raise the straightened conveyor 14 sufficiently so that the screen device 54 can be moved towards its operational position illustrated in FIG. 1 without fouling the ground. The hydraulic rams 30 are then operated to raise the conveyor 14 to its desired operational position, and locating pins are then inserted through the aligned box members in each box member assembly 34 to retain the conveyor 14 in its operational position. The hydraulic ram 66 is then operated to swing the screen device 54 into its correct operational screening position.

The conveyor belt 16 and the screen vibratory device are then operated from the hydraulic pump, the belt feeder assembly 52 is driven from the bottom drum pulley 70, and the screening apparatus is ready for use.

After use, the screening apparatus is converted into its transporting position by carrying out the aforementioned sequence of operations in reverse order.

An important advantage of the described and illustrated embodiment is that the chassis 2 can be formed by the skeleton part of a flat trailer as used in the haulage industry. This means that the chassis 2 can possess the necessary features which enable it to comply with various highway regulations.

Alternatively the feeder belt 72 may be driven by a hydrostatic variable speed drive powered by an extra pump on the diesel engine 64. Variable speed is effected by a flow control valve. The conveyor belt 16, the screen vibratory device and the feeder belt 72 are then operated from the hydraulic pumps.

I claim:

1. A mobile screening apparatus for separating particulate material of different sizes comprising:

a wheeled chassis;

an elongated conveyor adjustably mounted on the wheeled chassis for movement on the chassis between an elevated operational position and a folded transporting position, the conveyor including a lower rear section having a lower and an upper end and pivotally connected at the lower end to the chassis for movement between a lowered transporting position generally parallel with the chassis and an elevated operational position extending at an angle to the chassis, and an upper front section having a lower and an upper end, the lower end of the upper section being pivotally connected with the upper end of the lower section for folding between an operational position extending generally in alignment with the lower section and a transporting position generally parallel with and on top of the lower section; and a screening device pivotally connected to the upper end of the upper section of the conveyor for folding movement between an operational position projecting from the upper section and a transporting position generally parallel with and on top of the upper section; and actuating means extending between the wheeled chassis and the elongated conveyor to move the conveyor between lowered and elevated positions.

2. A screening apparatus as claimed in claim 1, wherein the actuating means includes a hydraulic ram system extending between the wheeled chassis and the conveyor rear section to enable the conveyor to move between an operational position and the transporting position.

3. A screening apparatus as claimed in claim 1, including a box girder system extending between the wheeled chassis and the conveyor rear section in parallel with the actuating means to retain the conveyor rear section in a desired operational position when the actuating means is deenergized.

4. A screening apparatus as claimed in claim 1, including a hydraulic ram system extending between the screen device and the conveyor forward section to enable the screen device to move between an operational position and the transporting position.

* * * * *